US005343850A

United States Patent [19]

Steer

[11] Patent Number: 5,343,850

[45] Date of Patent: Sep. 6, 1994

[54] DOUBLE SHOT PROJECTILE LAUNCHER

[76] Inventor: Michael Steer, 416 W. Huron, Ann Arbor, Mich. 48103

[21] Appl. No.: 931,085

[22] Filed: Aug. 17, 1992

[51] Int. Cl.[5] ..... F41B 11/24

[52] U.S. Cl. ..... 124/64; 124/59; 124/73

[58] Field of Search ..... 124/41.1, 56, 59, 63, 124/64, 69–74, 76, 83

[56] References Cited

U.S. PATENT DOCUMENTS

| | | | |
|---|---|---|---|
| 33,344 | 9/1861 | Gedney . | |
| 1,088,689 | 3/1914 | Eck | 124/69 |
| 1,873,677 | 8/1932 | Traver . | |
| 2,409,653 | 10/1946 | Amdur . | |
| 2,964,031 | 12/1960 | Dotson | 124/71 X |
| 2,991,782 | 7/1961 | Ayala . | |
| 2,993,297 | 7/1961 | Bednar et al. . | |
| 3,022,779 | 2/1962 | Benkoe | 124/64 X |
| 3,055,352 | 9/1962 | Foster . | |
| 3,087,481 | 4/1963 | Foster . | |
| 3,102,525 | 9/1963 | Englis | 124/74 X |
| 3,301,246 | 1/1967 | Wolfe . | |
| 3,342,171 | 9/1967 | Ryan et al. . | |
| 3,397,476 | 8/1968 | Weber | 124/72 X |
| 3,469,340 | 9/1969 | Breneman et al. . | |
| 4,076,006 | 2/1978 | Breslow et al. | 124/64 |
| 4,086,902 | 5/1978 | Reynolds | 124/61 |
| 4,159,705 | 7/1979 | Jacoby | 124/63 |
| 4,411,249 | 10/1983 | Fogarty et al. | 124/64 |
| 4,548,190 | 10/1985 | Megargee | 124/56 |
| 4,848,307 | 7/1989 | Tsao | 124/59 |
| 4,890,597 | 1/1990 | Ekstrom | 124/71 X |
| 4,892,081 | 1/1990 | Moormann | 124/65 |
| 4,897,065 | 1/1990 | Fertig et al. | 446/63 |

OTHER PUBLICATIONS

Nerf Master Blaster, Parker Brothers Catalog appox Jan. 1992.

Nerf Bow'N Arrow, Parker Brothers Package approx Jun. 1991.

*Primary Examiner*—Randolph A. Reese
*Assistant Examiner*—John Ricci
*Attorney, Agent, or Firm*—Roy A. Ekstrand

[57] ABSTRACT

A double shot projectile launcher includes a hollow pistol-like body supporting a pair of forwardly extending hollow launch tubes having open ends. A pair of lightweight projectiles defining interior closed end passages are received upon the launch tubes. Each launch tube defines an annular detent groove which cooperates with an inwardly extending seal member on the projectiles to provide a sealing engagement and restraining force to improve launch performance. A compressible air bellows is supported on the upper portion of the gun body and is coupled to the launch tube through an air selection valve and trigger mechanism which permits the coupling of pressurized air from the bellows upon impact thereto to be directed selectively to either of the launch tubes through trigger positioning.

13 Claims, 2 Drawing Sheets

DOUBLE SHOT PROJECTILE LAUNCHER

FIELD OF THE INVENTION

This invention relates generally to toy projectile launchers and particularly to those utilizing an air pressure launch mechanism.

BACKGROUND OF THE INVENTION

A great variety of toy playsets produced through the years have involved a launching of a projectile of one sort or another. In one variant of such playsets, a gun-like launcher supports one or more projectiles which are launched either through a spring-loaded launching mechanism or an air pressure driven launching device. The projectiles have enjoyed equally varied shapes and have included ping-pong balls, foam resilience balls, lightweight missiles and foam bodied arrows or missiles.

In the typical toy missile launcher using either a lightweight missile or foam bodied arrow for missile, a source of air pressure such as a pump or bellows is coupled to a hollow tube. The lightweight missile or foam bodied arrow in turn defines a cooperating closed end passage and is snugly fitted upon the hollow tube. The release of a burst of pressurized air into the hollow tube launches the arrow or missile.

One such product is presently marketed under the name of Nerf Bow 'N Arrow by Parker Brothers and includes a simulated bow and arrow having a center mounted plunger mechanism and a forwardly extending hollow launch tube coupled thereto. The plunger mechanism is spring-biased to its forward condition permitting the user to draw the plunger away from the bow center against the spring force storing spring energy therein. Upon release of the plunger, the spring force thrusts the plunger forward pressurizing air within the launch tube. A foam arrow received upon the launch tube via a closed end passage is launched in response to the pressurized air.

Another product presently marketed under the name Nerf Master Blaster by Parker Brothers sets forth a foam ball gun having a pair of launching barrels and a bidirectional plunger air pressure mechanism coupled to a movable handle. The plunger couples pressurized air to the upper barrel in one direction of motion launching a ball therefrom and to the lower barrel in the opposite direction of motion launching a foam ball therefrom. Rapid back and forth movements of the plunger provide alternating foam ball launches from the upper and lower launch tube.

U.S. Pat. No. 4,548,190 issued to Megargee sets forth an AIR PROPELLED PROJECTILE LAUNCHER having a gun-like housing defining a barrel formed of tubular resilient material. The rear barrel portion is sealed while the forward barrel portion receives a cylindrically shaped projectile. The projectile is tightly fitted within the cylinder bore and is launched therefrom when the user strikes the upper portion of the resilient barrel to deform the barrel and produce pressurized air therein.

U.S. Pat. No. 3,344 issued to Gedney sets forth an AIR GUN having a hollow barrel, a squeezably deformable handle and a trigger valve mechanism. The rapid squeezing of the handle and pressing of the trigger valve produces air pressure within the barrel which launches a projectile therein.

U.S. Pat. No. 1,873,677 issued to Traver sets forth a PROJECTILE SHOOTING GUN having an elongated barrel coupled to an upwardly extending tubular magazine and a generally disk-shaped air reservoir. The air reservoir defines an outwardly extending resilient convex surface. A plurality of projectiles are loaded into the magazine and are exposed one at a time to the cylinder bore. The positioned projectile is launched by the user's rapid strike against the resilient air housing deforming the resilient member and collapsing it inwardly.

U.S. Pat. No. 2,409,653 issued to Amdur sets forth a TOY ROCKET GUN having a supporting frame which receives and supports a tubular launcher. A collapsible air bulb is coupled to the launch tube which receives a launchable rocket. The rocket is launched by rapidly squeezing the air bulb.

U.S. Pat. No. 2,991,782 issued to Ayala sets forth a TOY having an elongated tubular plunger mechanism supporting a movable piston therein which is coupled to a handle at the opposite end. A simulated missile is coupled to the output end of the plunger assembly and restrained thereto. The rapid forward movement of the handle forces the piston into the plunger cylinder bore compressing the air therein and driving the missile from the launcher.

U.S. Pat. No. 2,993,297 issued to Bednar, et al. sets forth a TOY ROCKET having a tubular rocket launcher receiving a rocket having a closed end passage therein. An elongated flexible hollow tube extends downwardly from the launcher and terminates in a collapsible air bulb. The user holds and directs the rocket launcher while placing the bulb on the floor and rapidly collapsing the bulb with the user's foot to pressurize air and launch the missile.

U.S. Pat. Nos. 3,087,481 and 3,055,352 both issued to Foster and both entitled TOY GUN set forth similar toy gun structures having a gun-like hollow housing formed of a squeezable resilient material. A barrel portion within the gun housing receives a plurality of to-be-launched balls which are forced outwardly from the barrel under air pressure as the handle is squeezed.

U.S. Pat. No. 3,301,246 issued to Wolfe sets forth a COMPRESSED AIR ROCKET PROPELLING DEVICE having a pair of telescoping tubular members each supporting a downwardly extending handle. A rocket having a closed end launch passage is received upon the forwardmost of the telescoping tubular members and is launched when the user rapidly draws the two handles together telescoping the inner tubular member into the outer member to produce pressurized air.

U.S. Pat. No. 3,342,171 issued to Ryan, et al. sets forth a TOY POP GUN HAVING AN AIR PUMP WITH A RESILIENTLY FLEXIBLE MOVABLE CHAMBER CLOSURE MEMBER includes a pressurized chamber, a controlling trigger and a sounding membrane which cooperate to produce a popping sound when the trigger is pulled.

U.S. Pat. No. 3,469,340 issued to Breneman, et al. set forth a PNEUMATIC TOY VEHICLE PROPULSION SYSTEM having a hollow closed loop vehicle conducting tube within which a toy vehicle is driven by air pressure within the tube. An air bellows and valve mechanism is provided to pressurize the tube behind the toy vehicle.

U.S. Pat. No. 4,076,006 issued to Breslow, et al. sets forth a TOY ROCKET WITH PNEUMATIC LAUNCHER having a pivotable launch tube coupled to a collapsible air bulb. A lightweight rocket having a closed end launch tube is received upon the launcher tube and is launched therefrom as the user rapidly collapses the bulb.

U.S. Pat. No. 4,086,902 issued to Reynolds sets forth TOY PROJECTILE LAUNCHING APPARATUSES having a housing shaped to correspond to a machine gun or the like and including an upwardly extending magazine. A plurality of projectiles are stacked within the magazine and the bottommost projectile is aligned with the machine gun barrel. An air driven plunger assembly includes a plunger rod which is driven into the bottommost projectile to launch each time air pressure from a collapsible bellows is applied to the plunger assembly.

U.S. Pat. No. 4,159,705 issued to Jacoby sets forth a TOY PROJECTILE LAUNCHING DEVICE having a miniaturized cannon defining a launching bore which receives a to-be-launched projectile. The breach portion of the cannon is equipped with an inflatable air bladder and a movable piston valve. A squeezable bulb is coupled to the piston valve and is operated to actuate the valve to either launch the projectile or inflate the bladder.

U.S. Pat. No. 4,411,249 issued to Fogarty, et al. sets forth a TOY GLIDER WITH PNEUMATIC LAUNCHER formed to comprise a bracelet worn upon the user's wrist. The launcher includes a forwardly extending launch tube on its upper portion and a hollow collapsible air bulb on its lower portion. A lightweight missile having a closed end passage is received upon the launch tube and launched therefrom in response to the user's rapid squeezing of the air bulb.

U.S. Pat. No. 4,892,081 issued to Moormann sets forth a COLLAPSIBLE BALL LAUNCHER having an elongated cylindrical barrel supporting a movable piston and piston rod therein. A handle is coupled to the outwardly extending end of the piston rod. A ball chamber defines a front constriction and is coupled to the piston end of the piston cylinder. A foam ball is received within the ball chamber and driven therefrom by the forward movement of the piston.

U.S. Pat. No. 4,897,065 issued to Fertig, et al. sets forth a TOY VEHICLE AND HANDHELD PNEUMATIC LAUNCHER having an elongated cylinder within which a movable piston and piston rod are supported. The piston rod extends outwardly from the cylinder and terminates in a handle while a pair of outwardly extending handles are supported on either side of the cylinder. A launch tube is secured to the opposite end of the cylinder and is coupled to the cylinder interior. A launchable vehicle includes a closed end passage received upon the launch tube which is launched as the piston is driven into the cylinder to pressurize the air therein.

While the foregoing described prior art devices have provided some measure of enjoyment and amusement for the user, there remains nonetheless a continuing need in the art for evermore interesting and improved projectile launchers.

SUMMARY OF THE INVENTION

Accordingly, it is a general object of the present invention to provide an improved projectile launcher. It is a more particular object of the present invention to provide an improved double shot projectile launcher having dual launch capability.

In accordance with the present invention, there is provided a double shot projectile launcher for use in launching a pair of projectiles each having closed end passages, said launcher comprises: a body having a handle; a pair of hollow launch tubes supported upon the body; air pressure means for producing a flow of pressurized air; valve means for selectively coupling the air pressure means to the launch tubes; and actuator means for controlling the valve means.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
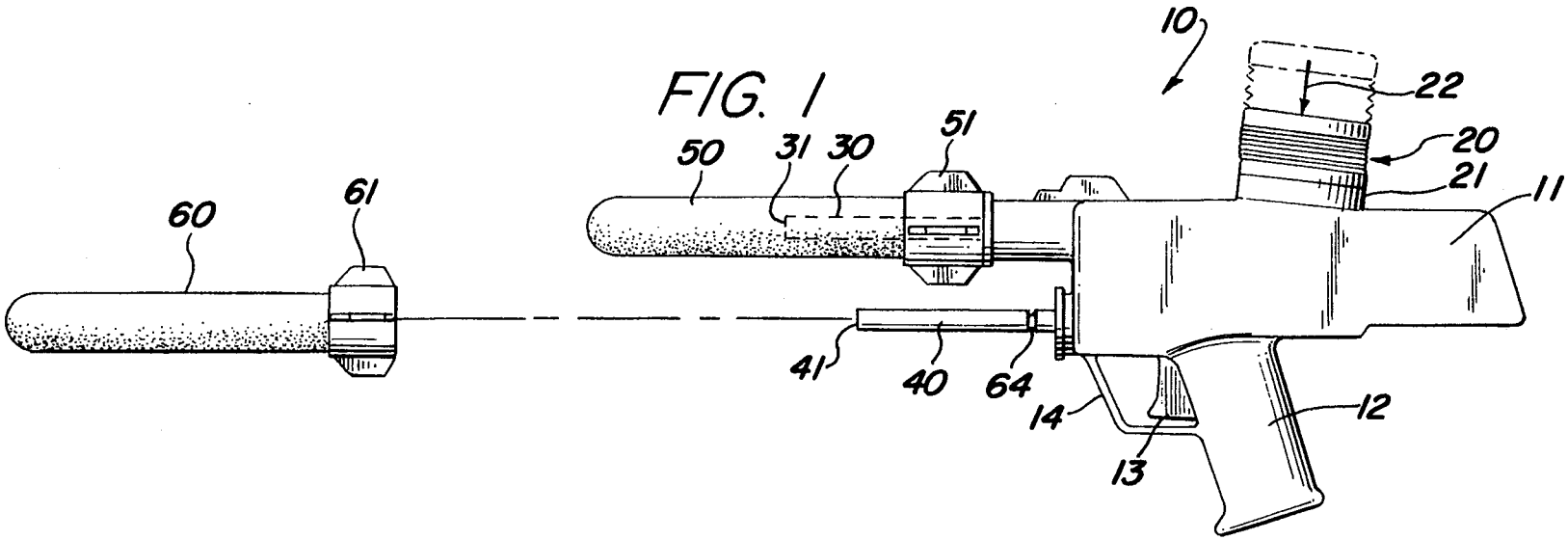
FIG. 1 sets forth a side view of the present invention double shot projectile launcher launching a first projectile.

FIG. 1 sets forth a side view of a double shot projectile launcher constructed in accordance with the present invention and generally referenced by numeral 10. Launcher 10 includes a hollow launcher body 11 configured to generally replicate a gun and defining a downwardly extending handle 12, a trigger guard 14 and a bellows base 21. Launcher 10 further includes a forwardly extending generally cylindrical upper launch tube 30 having an open end 31 and a similar generally cylindrical forwardly extending lower launch tube 40 having an open end 41. As is better seen in FIG. 2, launch tubes 30 and 40 define annular detent grooves 54 and 64 respectively, the function of which is set forth below in greater detail. Launcher body 11 further supports a trigger button 13 which is coupled to an air selection valve 70 (seen in FIG. 3). A collapsible air bellows 20 is received upon and supported by bellows base 21 and is collapsible in the direction indicated by arrow 22.

A pair of projectiles 50 and 60 are receivable upon upper launch tube 30 and lower launch tube 40 in the manner set forth below in FIG. 3. Projectile 50 includes a fin assembly 51 while projectile 60 includes a thin assembly 61. The structures of projectiles 50 and 60 as well as their sealing engagement with launch tubes 30 and 40 is set forth below in greater detail in conjunction with FIG. 3. However, suffice it to note here that projectiles 50 and 60 each define closed end passages which permit projectiles 50 and 60 to be received upon launch tubes 30 and 40 to prepare the projectiles for launch.

In operation, projectile launcher 10 may selectively launch either the projectile supported upon upper launch tube 30 (projectile 50 in this case) or the projectile supported upon lower launch tube 40 (projectile 60 in this case) in response to the position of trigger 13.

With trigger 13 in the extended position shown in FIG. 1, the internal air selection valve (valve 70 seen in FIG. 3) couples the pressurized air from air bellows 20 during its collapse to lower launch tube 40. Thus, in FIG. 1, the user having left trigger 13 extended and rapidly forced air bellows 20 in the direction of arrow 22 to collapse and pressurize the air within launch tube 40 has launched projectile 60. Thereafter, the user withdraws the collapsing force from air bellows 20 which returns to its expanded position shown in dashed-line representation due to its resilient characteristic. Once air bellows 20 has returned to its extended position, the user may launch projectile 50 from upper launch 30 by squeezing trigger 13 inwardly in the manner shown in FIG. 2 and again rapidly collapsing air bellows 20 to pressurize the air within upper launch tube 30 and launch projectile 50 in the manner shown in FIG. 2.

Figure 2:
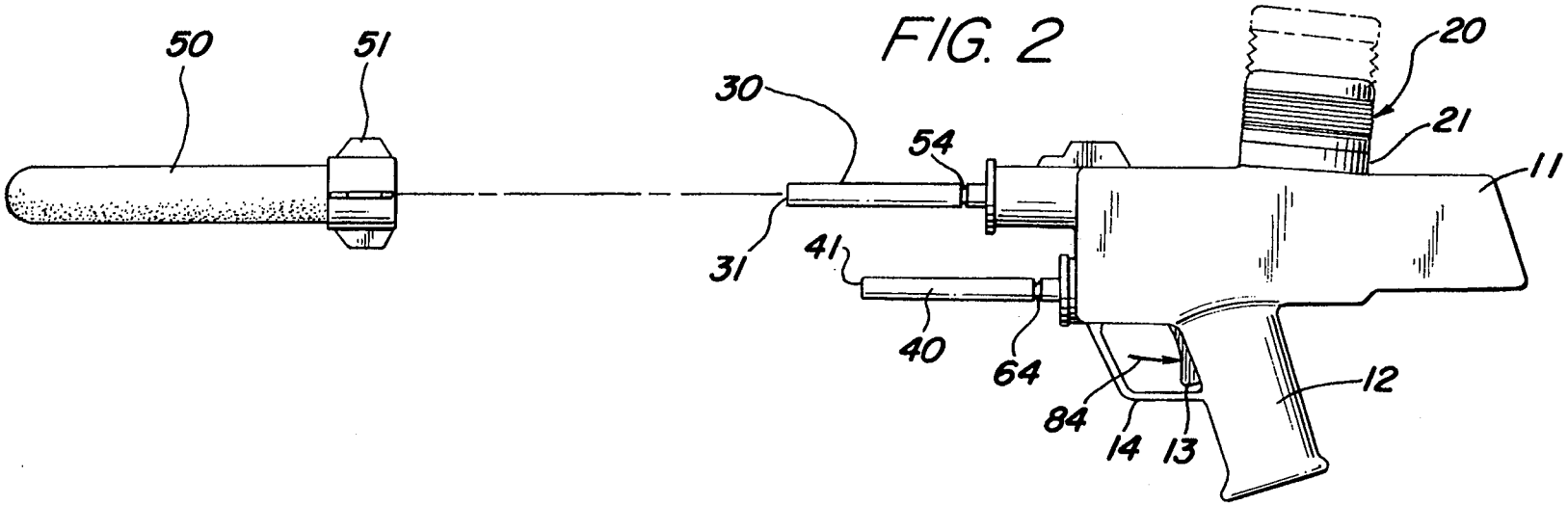
FIG. 2 sets forth a side view of the present invention double shot projectile launcher launching a second projectile.

FIG. 2 sets forth projectile 10 having just completed the above-described launch of projectile 50 from upper launch tube 30. As can be seen in FIG. 2, both upper launch tube 30 and lower launch tube 40 define annular detent rings 54 and 64 respectively and open end 31 and 41 respectively. Thus, the user may selectively operate trigger 13 between the extended position shown in FIG. 1 and the collapsed position shown in FIG. 2 to direct the air pressure produced by the collapse of air bellows 20 to either upper launch tube 30 or lower launch tube 40. Thus, the present invention projectile launcher provides a double shot capability.

Figures 3, 4:
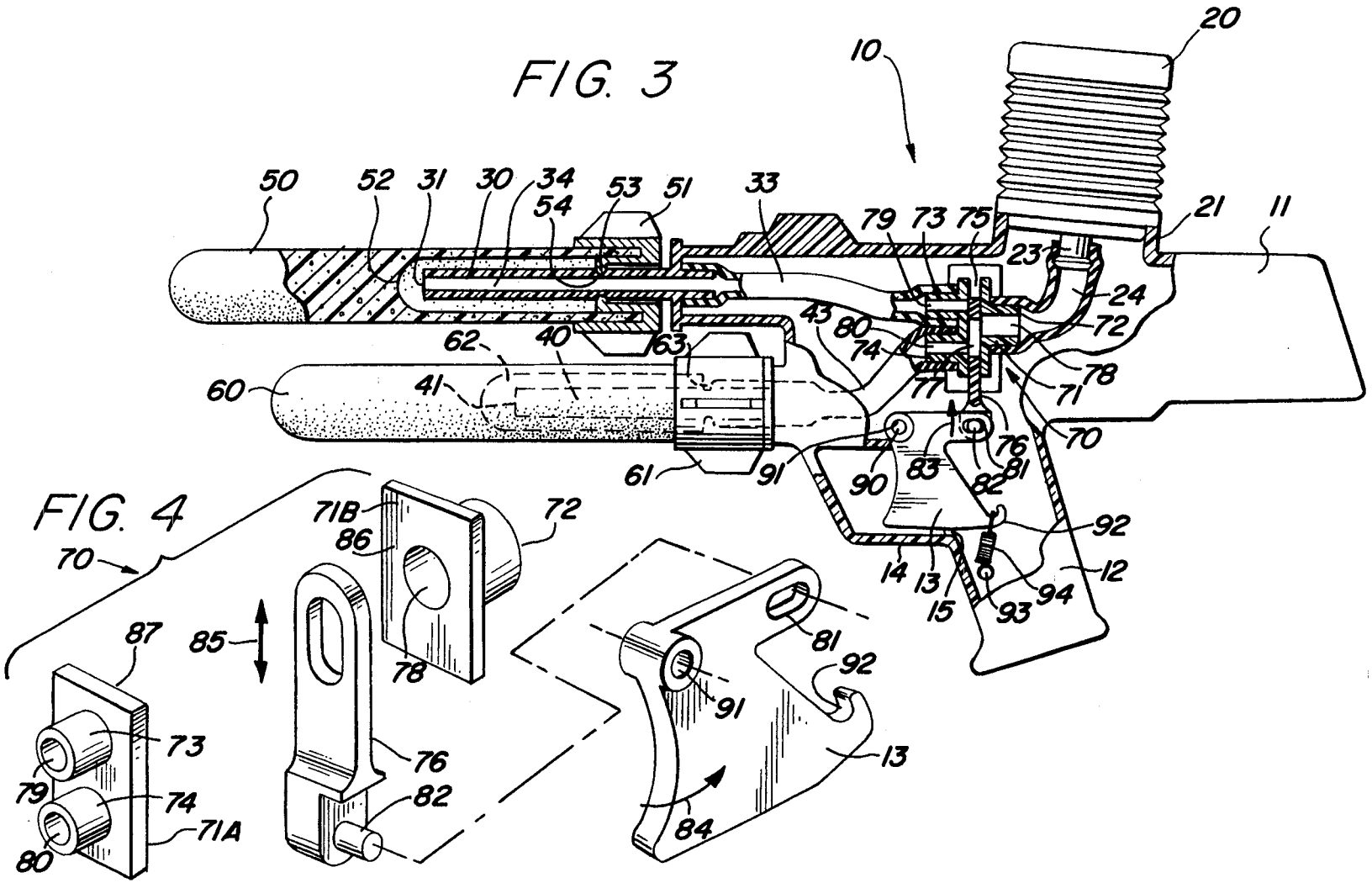
FIG. 3 sets forth a partially sectioned side view of the present invention double shot projectile launcher.
FIG. 4 sets forth a perspective assembly view of the trigger mechanism of the present invention double shot projectile launcher.

FIG. 3 sets forth a partial section view of launcher 10 having projectiles 50 and 60 loaded thereon. Launcher 10 includes a hollow body 11 defining a downwardly extending handle 12, a trigger guard 14 and a cylindrical bellows space 21. A collapsible air bellows 20 is received upon and secured to bellows space 21 and includes a downwardly extending air coupler 23. Body 11 further includes a pair of forwardly extending launch tubes 30 and 40 defining respective interior air passages 34 and 44 respectively (the latter not shown). Launch tubes 30 and 40 further define respective open ends 31 and 41 and annular detent grooves 54 and 64 (better seen in FIG. 2). A pair of couplers 32 and 43 extend inwardly from launch tubes 30 and 40 respectively. A pair of projectiles 50 and 60 are received upon launch tubes 30 and 40 respectively. It should be noted that projectile 60 is identical to projectile 50 and thus the projectiles are interchangeable upon launch tubes 30 and 40. Furthermore, as a result it should be understood that the description of projectile 50 which follows applies equally well to the structure of projectile 60. Accordingly, projectile 50 defines a closed end passage 52 and a fin assembly 51. Projectile 50 is preferably formed of a soft resilient foam material and is secured to fin assembly 51 in accordance with conventional fabrication techniques. Fin assembly 51 defines an inwardly extending annular seal 53 which is received within detent groove 54 of launch tube 30 to provide a sealing engagement between projectile 50 and launch tube 30. In addition, the extension of seal 53 into detent groove 54 provides a restraining force against the launch of projectile 50.

An air selection valve 70 includes a valve body 71 having an input coupler 72 defining a coupling passage 78 therein and a pair of output couplers 73 and 74 defining coupling passages 79 and 80 respectively. Valve body 71 defines a channel 75 between input coupler 72 and output couplers 73 and 74. A slide valve 76 comprises a generally planar slide member which is tightly fitted within channel 75 and movable in a sliding motion. Slide valve 76 defines a valve passage 77. Slide valve 76 further defines a coupling pin 82. Trigger 13 is received within trigger aperture 15 of body 11 and defines an aperture 91 which is received upon a support post 90. Post 90 is formed within body 11 and provides a pivotal support for trigger 13. Trigger 13 further defines a slot 81 which receives coupling pin 82 of slide valve 76 and a spring hook 92 which receives one end of a coil spring 94. The remaining end of coil spring 94 is coupled to a support post 93 formed with in the interior of body 11. A pair of flexible hollow tubes 33 and 34 are coupled between coupler 32 and 73 and between coupler 42 and 74 respectively. A flexible tube 24 is coupled between coupler 23 of air bellows 20 and input coupler 72 of air selection valve 70.

In operation, projectiles 50 and 60 are loaded upon launch tubes 30 and 40 and positioned such that seals 53 and 63 are seated within detent grooves 54 and 64 respectively. Thereafter, the user selects the projectile to be launched by manipulation of trigger 13. Thus, with trigger 13 in the relaxed position shown in FIG. 3, spring 94 is contracted pivoting trigger 13 in a clockwise direction indicated by arrow 88. The position of trigger 13 resulting positions slide valve 76 in the manner shown in FIG. 3 such that aperture 77 is aligned with passage 80 of output coupler 74. Since output coupler 74 is coupled to lower launch tube 40 by flexible tube 43, the operation of launcher 10 by the user will result in launching projectile 60. Thus, with trigger 13 in the position shown, the user then applies an abrupt downward force or blow to air bellows 20 collapsing bellows 20 and forcing pressurized air through tube 24, passage 78, aperture 77, passage 80 and tube 43 into launch tube 40. The resulting burst of pressurized air overcomes the restraining force of seal detent 63 within detent groove 64. This restraining force provides a dual action in that it seals the pressurized air and restrains the launch of projectile 60 until the launching force of pressurized air is sufficient to overcome the restraining action. As a result, the overcoming of this restraining pressure produces a sudden and abrupt launch of projectile 60.

Once projectile 60 has been launched in this manner, the user permits air bellows 20 to relax which causes air bellows 20 to expand to its natural position shown in FIG. 3 as air is drawn inwardly through launch tube 40, tube 43, air selection valve 70 and tube 24. Once air bellows 20 has returned to its expanded configuration, the user may launch projectile 50 by squeezing trigger 13 inwardly in the direction indicated by arrow 84. The pivotal motion of trigger 13 in the direction of arrow 84 drives slide valve 76 upwardly within valve body 71 in the direction indicated by arrow 83 producing alignment of aperture 77 so as to provide an air coupling path between passages 78 and 79. With the continued force on trigger 13 maintained, this position of slide valve 76 is also maintained and the next downward force upon air bellows 20 produces a pressurized air burst which is coupled through passage 78, aperture 77 and passage 79 into tube 33 and launch tube 30. Once again, the restraining force of seal 53 within detent groove 54 increases the abruptness of launch and effectiveness of energy transfer between the pressurized air and projectile 50. At this point, the user has fired both projectiles and may then reload by placing projectiles against on the launch tube and repeating this launch process.

FIG. 4 set forth a perspective assembly view of air selection valve 70 and trigger 13. As described above, trigger 13 defines a spring hook 92, a slot 81 and an aperture 91. As is also described above, air selection valve 70 includes a valve body 71. In the perspective assembly figure shown in FIG. 4, valve body 71 comprises a pair of body portions 71A and 71B which may be supported so as to form channel 75 (seen in FIG. 3) therebetween in the manner shown and described above. Alternatively, body portions 71A and 71B may form portions of an integral molded single piece valve body having channel 75 formed therein. In either event, the important aspect of valve body 71 is the provision of a single input coupler 72 and a pair of output couplers 73 and 74 which may be selectively coupled using the position of slide valve 76. More specifically, body portion 71A defines a generally planar member having a planar surface 87 and a pair of generally cylindrical couplers 73 and 74 defining respective passages 79 and 80 therethrough. Body portion 71B defines a generally planar member having a planar surface 86 and defining a generally cylindrical coupler 72 having an input passage 78 formed therein. A slide valve 76 defines a generally planar member having an elongated aperture 77 formed therein and a coupling pin 82 formed on the lower portion thereof. As described above, air selection valve 70 is formed by placing slide valve 76 between surface 87 and 86 of body portions 71A and 71B respectively in a slidable arrangement. Thereafter, pin 82 is received within slot 81 of trigger 13 to complete the assembly of air selection valve 70.

What has been shown is a double shot projectile launcher which provides a collapsible air bellows for producing pressurized air which is selectively directed to either of two launch tubes using an air selection valve and trigger mechanism. The projectile launcher is relatively inexpensive to fabricate and has been found to be easily manipulated and learned by even the youngest of child users. The impact bellows located on the upper portion of the launcher body provides an exciting and effective play pattern for the child user in that the impacting force is favorably aligned with the supporting handle grasped by the user's other hand. In addition, the action of striking downwardly upon the air bellows produces a novel play pattern which has been found exciting by child users.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A double shot projectile launcher for use in launching a pair of projectiles each having closed end passages, said launcher comprising:
- a body having a handle;
- a pair of hollow launch tubes supported upon said body in a stationary attachment relative to said body;
- air pressure means for producing a flow of pressurized air;
- valve means for selectively coupling said air pressure means to one of said launch tubes and excluding the other; and
- actuator means for controlling said valve means to switch between said launch tubes.

2. A launcher as set forth in claim 1 wherein said air pressure means includes a collapsible member.

3. A launcher as set forth in claim 2 wherein said collapsible member includes an air bellows.

4. A launcher as set forth in claim 3 wherein said valve means includes:
- a valve body defining an input coupling, a pair of output couplings, and a channel therebetween; and
- a slide member, slidable within said channel and coupled to said actuator means and defining an aperture therethrough.

5. A launcher as set forth in claim 4 wherein said actuator means includes a trigger button coupled to said slide member and spring means biasing said trigger button to an extended position.

6. A launcher as set forth in claim 5 wherein said projectiles each define inwardly extending seal members within said closed end passages and wherein said launch tubes each define annular grooves for receiving said seal members.

7. A launcher as set forth in claim 6 wherein tubes are arranged in a vertical pair.

8. A launcher as set forth in claim 1 wherein said projectiles each define inwardly extending seal members within said closed and passages and wherein said launch tubes each define annular grooves for receiving said seal members.

9. A launcher as set forth in claim 1 wherein said valve means includes:
- a valve body defining an input coupling, a pair of output couplings, and a channel therebetween; and
- a slide member, slidable within said channel and coupled to said actuator means and defining an aperture therethrough.

10. A projectile launching toy comprising:
- a launcher body having air pressure means;
- a pair of launch tubes each supported by said body in a stationary attachment relative to said body and defining an open outer end, an inner end coupled to said air pressure means, and first restraint means;
- a projectile defining a closed end passage receiving said launch tube and having second restraint means cooperating with said first restraint means to partially restrain the launch of said projectile from said launch tube; and
- a switchable air pressure supply for alternately applying air pressure to one of said launch tubes while excluding the other launch tube.

11. A projectile launching toy as set forth in claim 10 wherein said first and second restraint means include a cooperating recess and projection.

12. A projectile launching toy as set forth in claim 11 wherein said first restraint means includes an annular groove and said second restraint means includes an inwardly extending annular seal member.

13. A projectile launching toy comprising:
- a plurality of launcher tubes;
- a launcher housing supporting said plurality of launcher tubes in a fixed stationary generally parallel arrangement;
- a source of pressurized air; and
- a valve selectively coupling said source of pressurized air to selected ones of said launcher tubes.

* * * * *